US010401759B2

(12) United States Patent
Eto

(10) Patent No.: US 10,401,759 B2
(45) Date of Patent: Sep. 3, 2019

(54) TONER CASE, IMAGE FORMING APPARATUS

(71) Applicant: KYOCERA Document Solutions Inc., Osaka-shi, Osaka (JP)

(72) Inventor: Daisuke Eto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/163,889

(22) Filed: Oct. 18, 2018

(65) Prior Publication Data

US 2019/0121259 A1 Apr. 25, 2019

(30) Foreign Application Priority Data

Oct. 20, 2017 (JP) ..... 2017-203378

(51) Int. Cl.
*G03G 15/08* (2006.01)
*G03G 21/20* (2006.01)

(52) U.S. Cl.
CPC ..... *G03G 15/0879* (2013.01); *G03G 15/0874* (2013.01); *G03G 15/0886* (2013.01); *G03G 15/0887* (2013.01); *G03G 21/206* (2013.01)

(58) Field of Classification Search
CPC ..... G03G 15/0877; G03G 15/0879; G03G 15/0886
See application file for complete search history.

(56) References Cited

U.S. PATENT DOCUMENTS

| | | | | |
|---|---|---|---|---|
| 6,201,941 | B1 * | 3/2001 | Kasahara | G03G 15/0822 399/106 |
| 6,826,381 | B2 * | 11/2004 | Muramatsu | G03G 15/0808 399/258 |
| 7,650,103 | B2 * | 1/2010 | Isomura | G03G 15/0874 399/258 |
| 9,360,816 | B1 | 6/2016 | Mabuchi et al. | |
| 2005/0163537 | A1 | 7/2005 | Muramatsu et al. | |
| 2006/0051136 | A1 | 3/2006 | Tsuda et al. | |
| 2007/0003325 | A1 * | 1/2007 | Jung | G03G 15/0894 399/258 |
| 2007/0009289 | A1 | 1/2007 | Muramatsu et al. | |
| 2007/0274740 | A1 | 11/2007 | Katoh et al. | |
| 2009/0185832 | A1 | 7/2009 | Muramatsu et al. | |
| 2011/0081168 | A1 | 4/2011 | Kimura | |

(Continued)

FOREIGN PATENT DOCUMENTS

JP 2005195659 A 7/2005

*Primary Examiner* — Carla J Therrien
(74) *Attorney, Agent, or Firm* — Alleman Hall Creasman & Tuttle LLP

(57) ABSTRACT

A toner case includes a case main body, a feeding mechanism, a displacement member, and an elastic member. The case main body stores toner. A ventilation port is formed in the case main body. The feeding mechanism feeds the toner to outside the case main body. The displacement member includes a seal portion and is configured to be displaced between a closing position and an opening position. When the displacement member is at the closing position, the seal portion closes the ventilation port, and when the displacement member is at the opening position, the seal portion opens at least a part of the ventilation port. The elastic member holds the displacement member at the closing position by applying an elastic force to the displacement member.

3 Claims, 9 Drawing Sheets

(56) References Cited

U.S. PATENT DOCUMENTS

| | | | | |
|---|---|---|---|---|
| 2011/0255907 | A1 | 10/2011 | Mihara et al. | |
| 2013/0272750 | A1 | 10/2013 | Matsumoto et al. | |
| 2013/0322927 | A1 | 12/2013 | Matsumoto et al. | |
| 2014/0368586 | A1* | 12/2014 | Usui ..... | B41J 2/17513 347/86 |
| 2015/0346638 | A1 | 12/2015 | Mizusawa et al. | |

* cited by examiner

TONER CASE, IMAGE FORMING APPARATUS

INCORPORATION BY REFERENCE

This application is based upon and claims the benefit of priority from the corresponding Japanese Patent Application No. 2017-203378 filed on Oct. 20, 2017, the entire contents of which are incorporated herein by reference.

BACKGROUND

The present disclosure relates to a toner case having a mechanism for feeding toner from its main body and to an image forming apparatus including the toner case.

In general, an electrophotographic image forming apparatus includes a toner case attached thereto in a detachable manner. The toner case may be referred to as a toner container or a toner case.

The toner case includes a main body and a screw feeder, wherein the main body is configured to store toner, and the screw feeder feeds the toner from the main body. The toner fed from the main body is supplied to a developing device.

In addition, it is known that the toner may be conveyed from the main body of the toner case to the developing device by an air flow or a powder pump.

SUMMARY

A toner case according to an aspect of the present disclosure includes a case main body, a feeding mechanism, a displacement member, and an elastic member. The case main body stores toner. A ventilation port is formed in the case main body. The feeding mechanism feeds the toner to outside the case main body. The displacement member includes a seal portion and is configured to be displaced between a closing position and an opening position. When the displacement member is at the closing position, the seal portion closes the ventilation port, and when the displacement member is at the opening position, the seal portion opens at least a part of the ventilation port. The elastic member holds the displacement member at the closing position by applying an elastic force to the displacement member.

An image forming apparatus according to another aspect of the present disclosure includes a developing device and the toner case. The developing device develops an electrostatic latent image on a photoconductor into a toner image. The toner case is attached, in a detachable manner, to an apparatus main body storing the developing device and supplies toner to the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment

Figure 1:
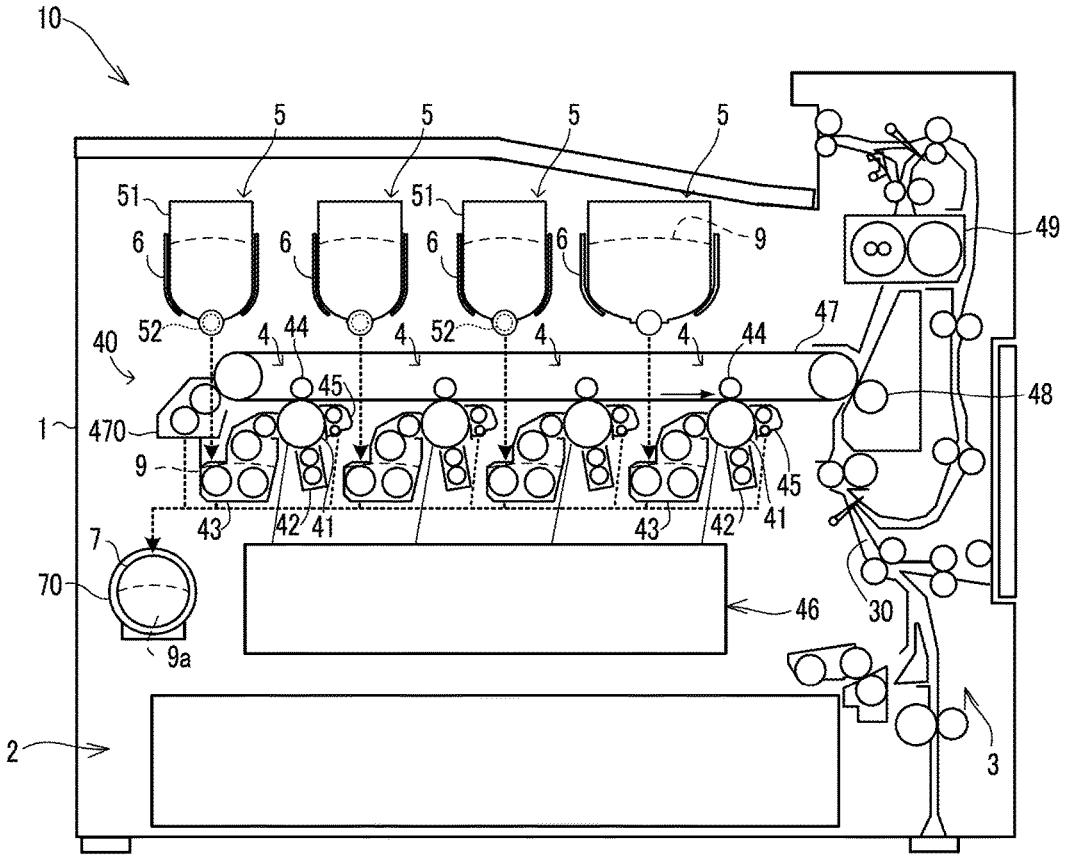
FIG. 1 is a configuration diagram of an image forming apparatus including toner cases according to a first embodiment.

As shown in FIG. 1, a toner case 5 according to a first embodiment is attached to an apparatus main body 1 of an image forming apparatus 10.

The image forming apparatus 10 is configured to form an image on a sheet by an electrophotographic system. The sheet is a sheet-like image formation medium such as a sheet of paper or a resin film.

The image forming apparatus 10 includes a sheet supply device 2, a sheet conveying device 3, a print processing device 40, a laser scanning device 46, a fixing device 49, the toner case 5, and a waste developer bottle 7.

The apparatus main body 1 of the image forming apparatus 10 is a housing storing the sheet conveying device 3, the print processing device 40, the laser scanning device 46, and the fixing device 49.

The print processing device 40 executes an image forming process of forming a toner image on a sheet. For example, the print processing device 40 executes the image forming process by using two-component developer that includes toner 9 and carrier. The carrier is a granular material having magnetism.

The image forming apparatus 10 shown in FIG. 1 is a tandem-type image forming apparatus and is a color printer. As a result, the print processing device 40 includes a plurality of image creating units 4 and a plurality of toner cases 5 that respectively correspond to a plurality of colors, an intermediate transfer belt 47, a secondary transfer device 48, and a secondary cleaning device 470.

Each of the image creating units 4 includes a photoconductor 41, a charging device 42, a developing device 43, a primary transfer device 44, and a primary cleaning device 45.

Each of the toner cases 5 is attached to a cartridge attachment portion 6 of the apparatus main body 1 in a detachable manner. The toner case 5 includes a main body 51 configured to store the toner 9, and a screw feeder 52 configured to feed the toner 9 from the main body 51. The toner case 5 supplies the toner 9 to the developing device 43 as the screw feeder 52 operates. The screw feeder 52 is an example of a feeding mechanism. In addition, the main body 51 corresponds to a case main body.

The toner 9 fed from the main body 51 is supplied to the developing device 43. When the main body 51 of the toner case 5 becomes empty with the toner 9, the toner case 5 is replaced with a new one.

The sheet supply device 2 feeds the sheet to a sheet conveyance path 30 provided in the apparatus main body 1, and the sheet conveying device 3 conveys the sheet along the sheet conveyance path 30.

The drum-like photoconductor 41 rotates, and the charging device 42 charges the surface of the photoconductor 41. Furthermore, the laser scanning device 46 writes an electrostatic latent image on the surface of the photoconductor 41 by scanning a laser beam.

Furthermore, the developing device 43 develops the electrostatic latent image on the photoconductor 41 into a toner image. The toner image is an image visible with the toner 9. Subsequently, the primary transfer device 44 transfers the toner image from the surface of the photoconductor 41 to the intermediate transfer belt 47. The primary cleaning device 45 removes the toner 9 that has remained on the surface of the photoconductor 41.

It is noted that the photoconductor 41 and the intermediate transfer belt 47 are examples of an image carrying member configured to carry an image of the toner 9.

The secondary transfer device 48 transfers the toner image formed on the intermediate transfer belt 47, to the sheet. The secondary cleaning device 470 removes the toner 9 that has remained on the intermediate transfer belt 47. The fixing device 49 fixes the toner image to the sheet by heating.

The toner 9 removed from the photoconductor 41 and the intermediate transfer belt 47 by the primary cleaning device 45 and the secondary cleaning device 470 is conveyed to the waste developer bottle 7 as waste developer 9*a*, and is stored in the waste developer bottle 7.

Furthermore, the toner 9 floating in the developing device 43 and part of the carrier that has deteriorated in the developing device 43 are collected in the waste developer bottle 7 as the waste developer. That is, the waste developer bottle 7 stores the waste developer that is used developer.

The waste developer bottle 7 is attached to a bottle attachment portion 70 of the apparatus main body 1 in a detachable manner. When the amount of the waste developer stored in the waste developer bottle 7 exceeds a predetermined allowable amount, the waste developer bottle 7 is replaced with a new one.

Meanwhile, in the toner case 5, it is desired to simplify the mechanism for feeding the toner 9 from the main body 51 to the developing device 43, and achieve space saving.

In addition, when the toner 9 is fed from the main body 51, a negative pressure is apt to be generated in the main body 51. The negative pressure in the main body 51 disturbs the feeding of the toner 9.

If an opening for ventilation is formed in the main body 51, the problem of the negative pressure generated in the main body 51 would be solved. However, the opening of the main body 51 may cause a toner leakage during conveyance of the toner case 5.

In the present embodiment, the toner case 5 has a structure that has a simple mechanism for feeding the toner 9 from the main body 51, and achieves space saving. Furthermore, the toner case 5 has a structure that solves the problems of the negative pressure generated in the main body 51 and the toner leakage. The following describes the structure of the toner case 5.

Figure 2:
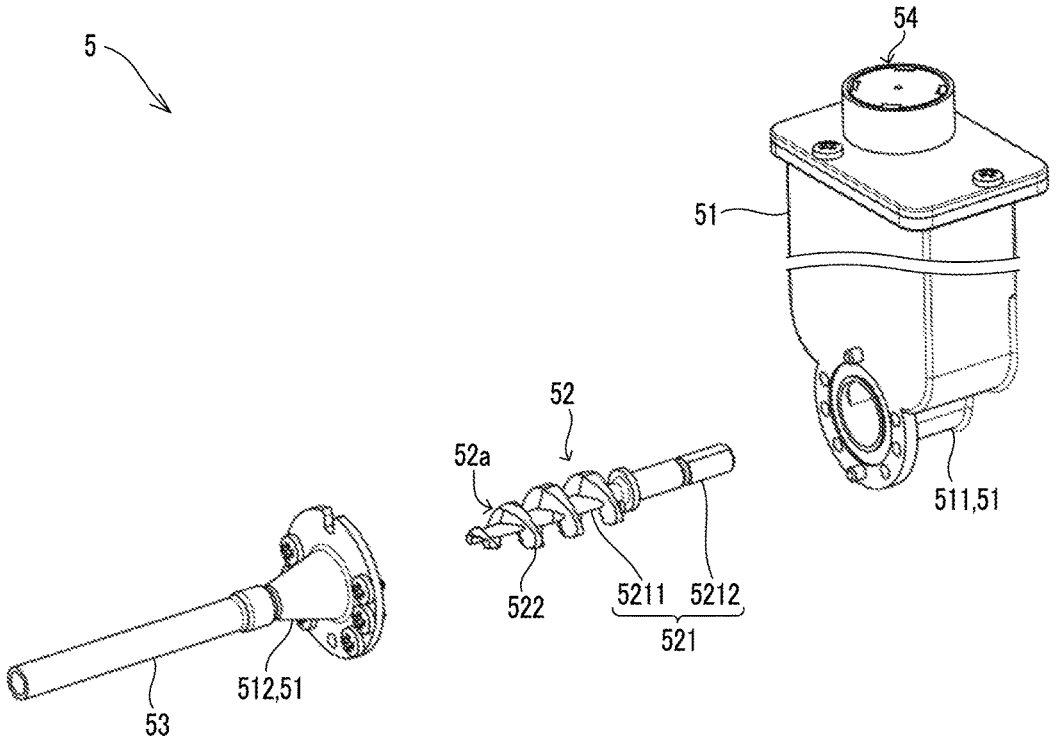
FIG. 2 is a disassembled oblique diagram of a toner case according to the first embodiment.
Figure 3:
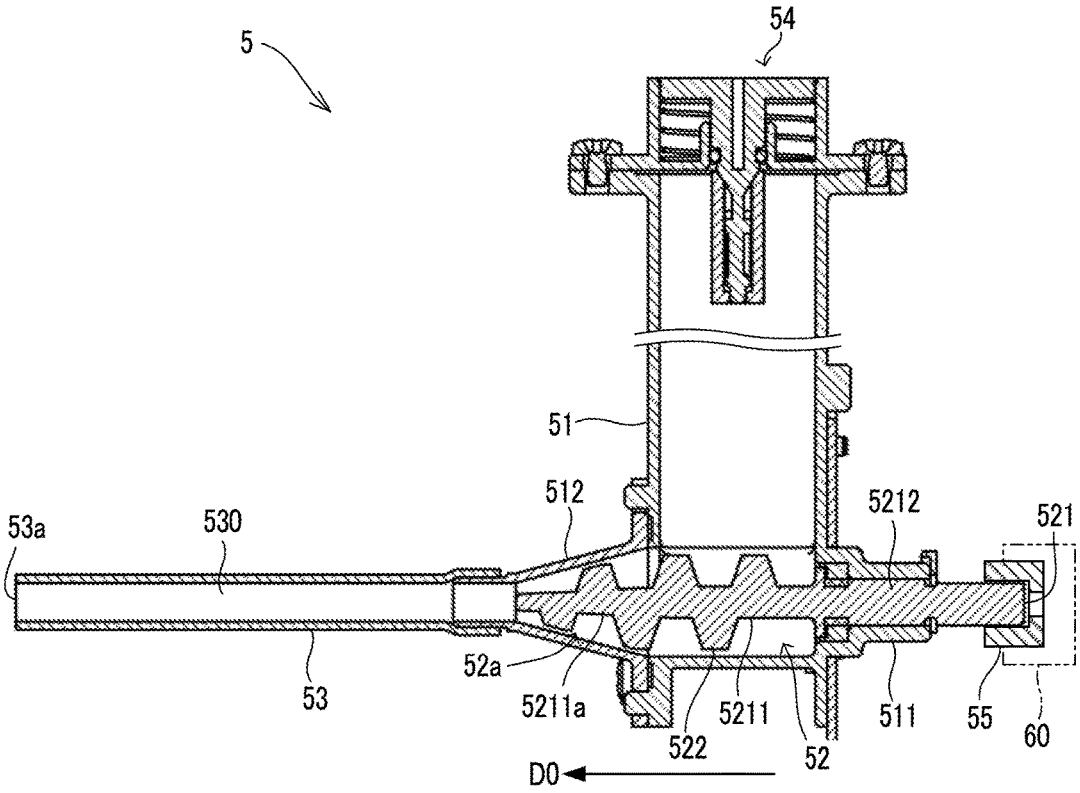
FIG. 3 is a cross-sectional diagram of the toner case according to the first embodiment.
Figure 4:
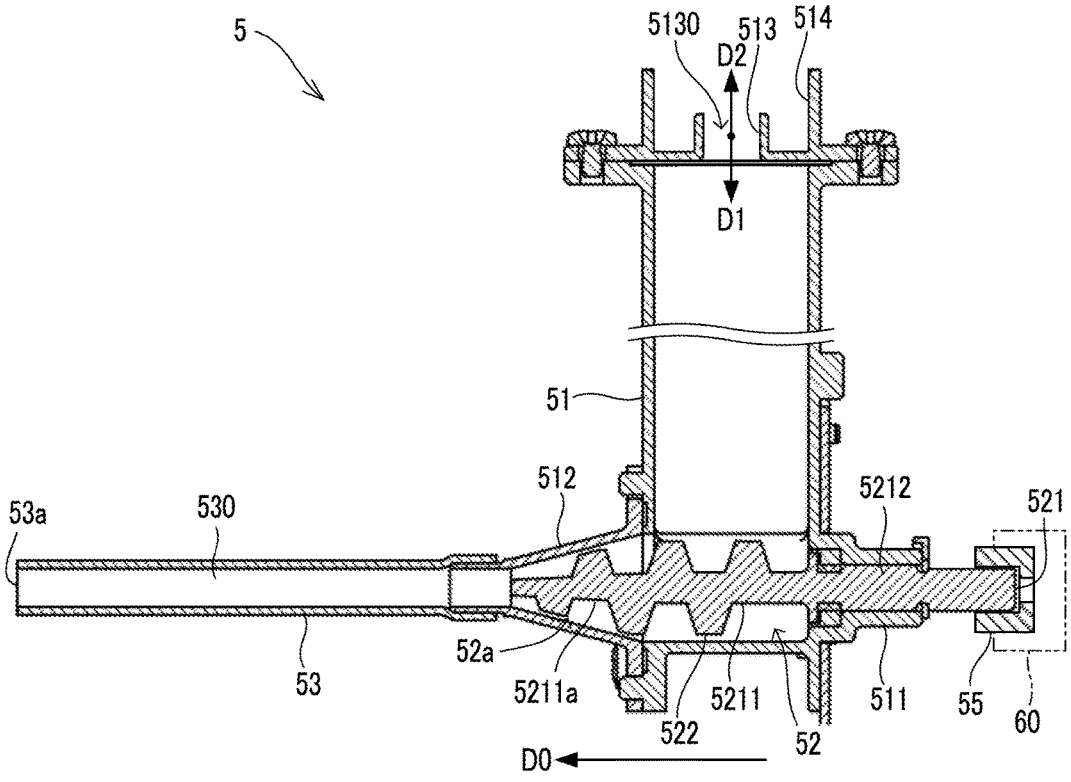
FIG. 4 is a cross-sectional diagram of the toner case in a state where a valve is removed.

As shown in FIG. 2 to FIG. 4, the toner case 5 includes the main body 51, the screw feeder 52, and a cylindrical body 53. Furthermore, the toner case 5 includes a valve 54.

As described above, the main body 51 stores the toner 9. As shown in FIG. 3 and FIG. 4, the cylindrical body 53 forms a toner conveyance path 530 that is communicated with an inside of the main body 51.

The screw feeder 52 includes a shaft 521 and a blade 522. The shaft 521 is formed to extend from the inside of the main body 51 toward an entrance to the toner conveyance path 530. The blade 522 is formed to project in a spiral shape from the shaft 521.

As shown in FIG. 3 and FIG. 4, the main body 51 includes, in its lower portion, a bearing portion 511 and an inner diameter tapering portion 512.

The bearing portion 511 is provided opposite to a portion of the main body 51 that is connected with the cylindrical body 53. The shaft 521 is rotatably cantilever supported by the bearing portion 511. The portion of the main body 51 that is connected with the cylindrical body 53 is the inner diameter tapering portion 512.

As shown in FIG. 2, the shaft 521 includes a first shaft portion 5211 and a second shaft portion 5212, wherein the blade 522 is formed on the circumference of the first shaft portion 5211, and not on the circumference of the second shaft portion 5212. The second shaft portion 5212 is rotatably supported by the first shaft portion 5211.

A part of the second shaft portion 5212 protrudes outside from the bearing portion 511 of the bearing portion 511. An engaging member 55 is fixed to the part of the second shaft portion 5212 that protrudes from the main body 51. When the toner case 5 is attached to the cartridge attachment portion 6, the engaging member 55 is coupled with a drive mechanism 60 that is provided in the apparatus main body 1.

The drive mechanism 60 applies a rotational force to the shaft 521 of the screw feeder 52 via the engaging member 55. This allows the screw feeder 52 to rotate.

A direction from the second shaft portion 5212 toward the first shaft portion 5211 in the longitudinal direction of the screw feeder 52 is a toner feeding direction D0.

The screw feeder 52 includes an outline tapering portion 52*a* in which the outline of the blade 522 tapers in the toner feeding direction D0.

As shown in FIG. 3 and FIG. 4, a portion of the first shaft portion 5211 that corresponds to the outline tapering portion 52*a* is a tapering shaft portion 5211*a*. The tapering shaft portion 5211*a* is formed to taper in the toner feeding direction D0.

The inner diameter tapering portion 512 of the main body 51 is formed in the shape of a cylinder that surrounds the circumference of the outline tapering portion 52*a*. The inner diameter tapering portion 512 is in the shape of the cylinder whose inner diameter gradually becomes smaller in the toner feeding direction D0.

The inner diameter of the cylindrical body 53 is smaller than the largest inner diameter of the inner diameter tapering portion 512. In addition, the inner diameter of the cylindrical body 53 is smaller than the largest outer diameter of the outline tapering portion 52*a* of the screw feeder 52.

The screw feeder 52 feeds the toner 9 from the main body 51 to the toner conveyance path 530 by being rotationally driven in the main body 51. This allows the toner 9 to be put near the entrance to the toner conveyance path 530.

Furthermore, the screw feeder 52 pushes the toner 9 at the entrance to the toner conveyance path 530 along the toner conveyance path 530 by applying a feeding pressure of the succeeding toner 9 thereto. This allows the toner 9 to be filled in the toner conveyance path 530, and fed out from an outlet 53*a* of the toner conveyance path 530.

It is noted that a cap (not shown) is attached to the cylindrical body 53 before the toner case 5 is attached to the cartridge attachment portion 6 of the apparatus main body 1. The cap closes the outlet 53*a* of the toner conveyance path 530. After the cap is removed from the cylindrical body 53, the toner case 5 is attached to the cartridge attachment portion 6 of the apparatus main body 1.

The toner 9 fed out from the toner conveyance path 530 is supplied to the developing device 43 directly or via an intermediate conveyance path (not shown).

In the example shown in FIG. 3 and FIG. 4, the cylindrical body 53 is a straight tube. However, the cylindrical body 53 may have a cylindrical shape that is curved downward from a horizontal direction.

As shown in FIG. 4, a ventilation port 5130 is formed in an upper portion of the main body 51. In the following description, an edge portion of the ventilation port 5130 of the main body 51 is referred to as an opening edge portion 513.

In addition, a direction from an outer side of the main body 51 toward an inner side of the main body 51 via the ventilation port 5130 is referred to as a first direction D1, and a direction opposite to the first direction D1 is referred to as a second direction D2 (see FIG. 4). The opening edge portion 513 is formed in the shape of a cylinder extending along the first direction D1. It is noted that the opening edge portion 513 may be formed in the shape of a rectangular tube extending along the first direction D1.

Furthermore, the main body 51 includes a guide portion 514 that is formed to extend in the first direction D1 on the circumference of the opening edge portion 513. In the present embodiment, the opening edge portion 513 and the guide portion 514 are formed along the concentric circles respectively.

The valve 54 changes its state between a closing state and an opening state, wherein the valve 54 in the closing state closes the ventilation port 5130, and the valve 54 in the opening state opens a part of the ventilation port 5130.

Figure 5:
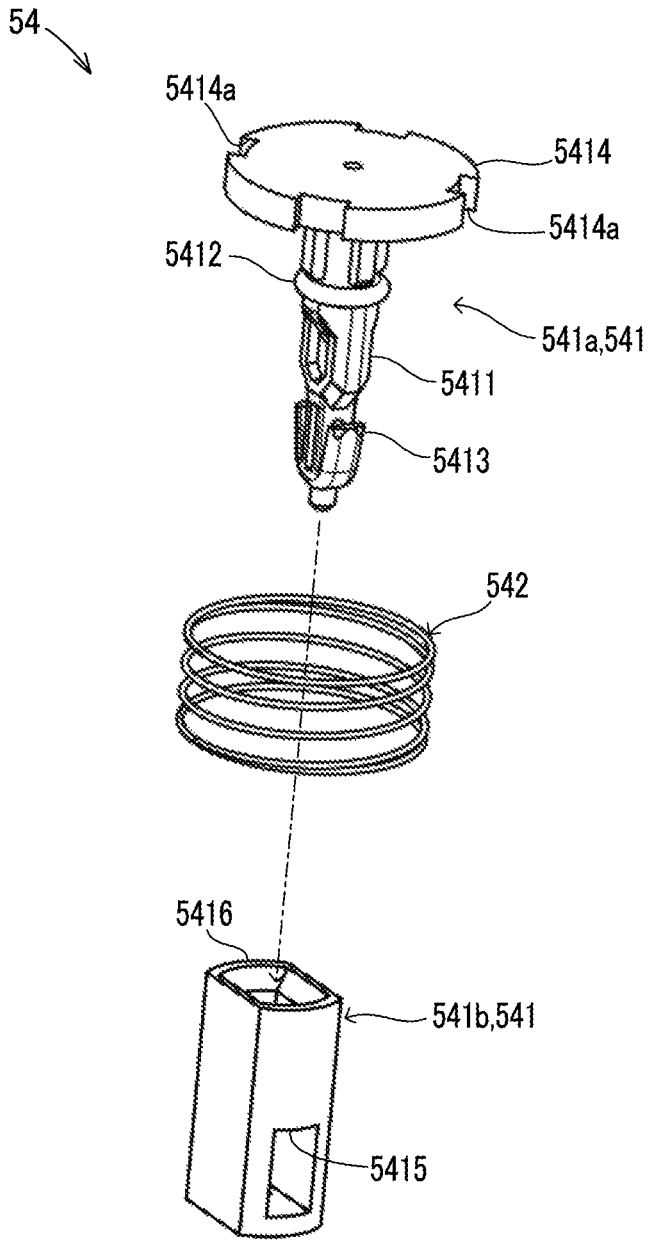
FIG. 5 a disassembled oblique diagram of the valve included in the toner case according to the first embodiment.

As shown in FIG. 5, the valve 54 includes a first displacement member 541*a* and a second displacement member 541*b* that, in combination with each other, form a displacement member 541. Furthermore, the valve 54 includes a spring 542.

The first displacement member 541*a* includes a pass-through portion 5411 that passes through the ventilation port 5130. The first displacement member 541*a* also includes a seal portion 5412, a first engaging portion 5413, and a flange portion 5414 that are integrally provided with the pass-through portion 5411, respectively.

The seal portion 5412 is provided on an intermediate portion of the pass-through portion 5411. The first engaging portion 5413 is provided on a side of a first end of the pass-through portion 5411, and the flange portion 5414 is provided at a second end of the pass-through portion 5411.

The first engaging portion 5413 is formed on a portion of the pass-through portion 5411 that is positioned inside the main body 51. On the other hand, the flange portion 5414 is formed on a portion of the pass-through portion 5411 that is positioned outside the main body 51.

The second displacement member 541*b* includes a second engaging portion 5415 and a stopper 5416. The first engaging portion 5413 and the second engaging portion 5415, by being engaged with each other, hold the first displacement member 541*a* and the second displacement member 541*b* integrally. The second displacement member 541*b* constitutes a part of the displacement member 541 that is positioned inside the main body 51.

The seal portion 5412 is formed along the entire outer circumference of the pass-through portion 5411. In the present embodiment, the seal portion 5412 is a ring member of a circular shape that is attached, in close contact, to an intermediate portion of the pass-through portion 5411.

Figure 6:
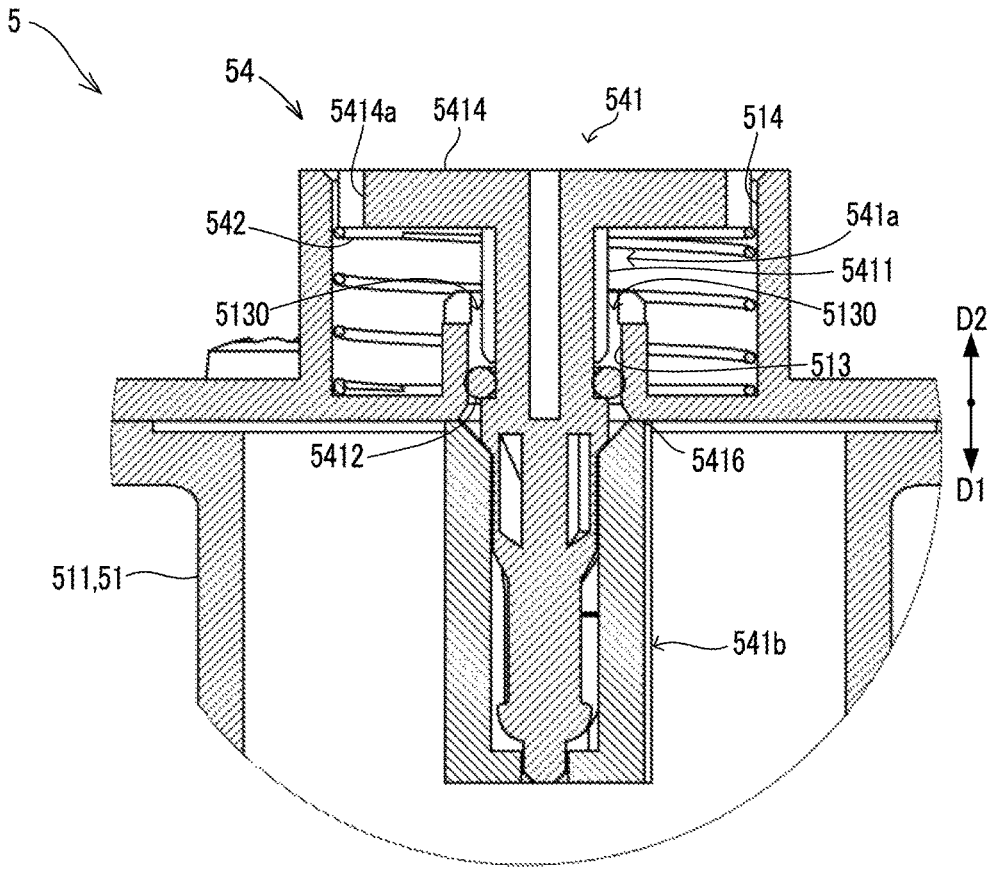
FIG. 6 is a cross-sectional diagram showing that the valve included in the toner case according to the first embodiment is in a closing state.

As shown in FIG. 6, the seal portion 5412 of the displacement member 541 closes the ventilation port 5130. The displacement member 541 can be displaced in the first direction D1 and the second direction D2. It is noted that the first direction D1 corresponds to a first displacement direction, and the second direction D2 corresponds to a second displacement direction.

The displacement member 541 is configured to be displaced between a closing position and an opening position, wherein when the displacement member 541 is at the closing position, the seal portion 5412 closes the ventilation port 5130, and when the displacement member 541 is at the opening position, the seal portion 5412 opens a part of the ventilation port 5130. FIG. 6 shows the displacement member 541 present at the closing position, and FIG. 7 shows the displacement member 541 present at the opening position.

Figure 7:
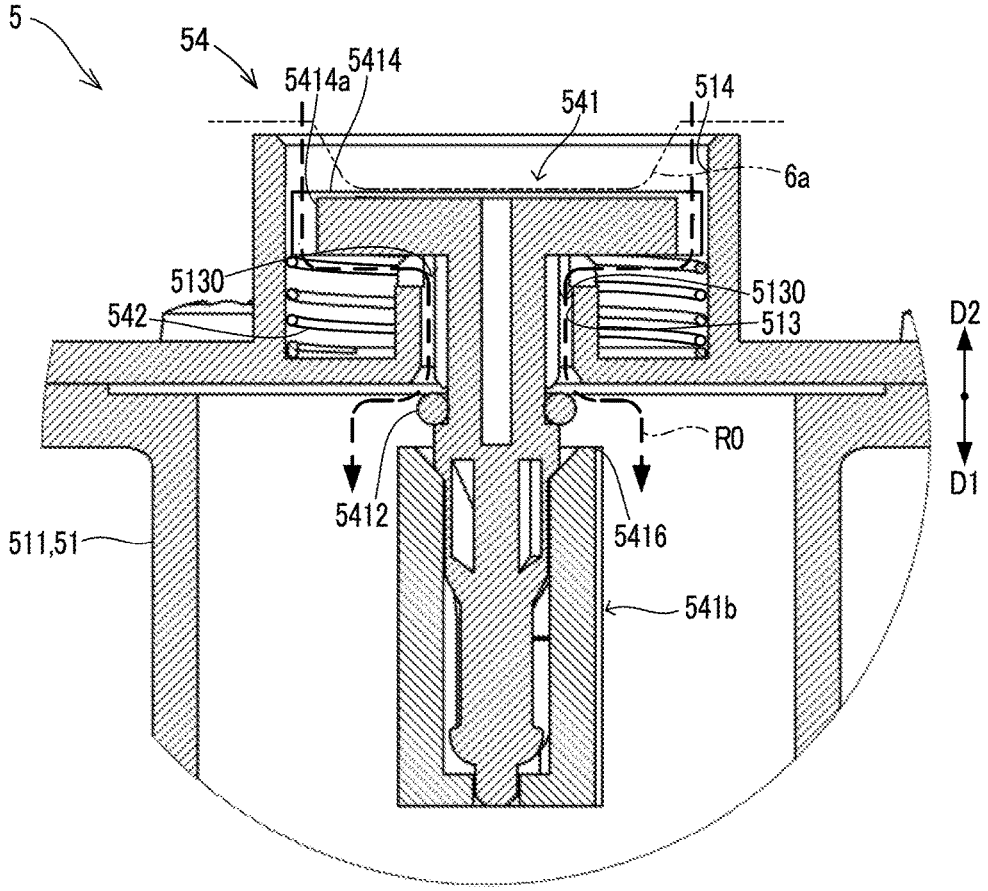
FIG. 7 is a cross-sectional diagram showing that the valve included in the toner case according to the first embodiment is in an opening state.

The guide portion 514 guides the flange portion 5414 of the displacement member 541 in the first direction D1 and the second direction D2 (see FIG. 6, FIG. 7). A cut portion 5414*a* is formed at an outer edge of the flange portion 5414. The cut portion 5414*a* forms a gap between the flange portion 5414 and the guide portion 514.

In addition, in a state where the displacement member 541 is present at the closing position, the stopper 5416 of the displacement member 541 abuts on an inner side surface of the main body 51. With this configuration, the stopper 5416 suppresses the displacement member 541 from being displaced in the second direction D2 (see FIG. 7).

In a state where the displacement member 541 is present at the closing position, the seal portion 5412 closes a gap in the ventilation port 5130 between the pass-through portion 5411 and the opening edge portion 513 (see FIG. 6). The seal portion 5412 closes the gap by coming in contact with an inner circumferential surface of the opening edge portion 513.

In a state where the displacement member 541 is present at the opening position, the seal portion 5412 opens the gap in the ventilation port 5130 between the pass-through portion 5411 and the opening edge portion 513 (see FIG. 7). As a result, when the displacement member 541 is present at the opening position, a ventilation path R0 is formed, wherein the ventilation path R0 communicates the outside and the inside of the main body 51 (see FIG. 7). The cut portion 5414*a* forms a part of the ventilation path R0.

In the present embodiment, the ventilation path R0 passes the gap between the flange portion 5414 and the guide portion 514, and the gap between the pass-through portion 5411 and the opening edge portion 513.

The spring 542 holds the displacement member 541 at the closing position by applying an elastic force to the flange portion 5414 of the displacement member 541. In the present embodiment, the spring 542 is a coil spring inserted in an inside of the guide portion 514. The spring 542 applies an elastic force in the second direction D2 to the flange portion 5414 of the displacement member 541.

It is noted that the spring 542 is an example of an elastic member. Another elastic member formed from rubber or the like may be adopted in place of the spring 542.

As shown in FIG. 7, the cartridge attachment portion 6 of the apparatus main body 1 includes a projection portion 6*a* that is configured to abut on the flange portion 5414 of the displacement member 541.

The projection portion 6*a* abutting on the flange portion 5414 of the displacement member 541 holds the displacement member 541 at the opening position against the elastic force of the spring 542.

As described above, when the displacement member 541 is displaced from the closing position along the first direction D1, the seal portion 5412 is displaced from a position where it closes the gap between the opening edge portion 513 and the pass-through portion 5411 to a position in the main body 51 that is separated from the opening edge portion 513, the opening edge portion 513 being the edge of the ventilation port 5130 of the main body 51.

With the adoption of the toner case 5, the need to dispose the screw feeder 52 in the toner conveyance path 530 is eliminated. This makes it possible to shorten the screw feeder 52, and make the cylindrical body 53 thinner. It is thus possible to simplify the mechanism for feeding the toner 9 from the main body 51, and achieve space saving.

In addition, by the action of the inner diameter tapering portion 512 and the outline tapering portion 52*a*, the toner 9 is fed smoothly from the main body 51 to the toner conveyance path 530 in the cylindrical body 53.

In addition, in a state where the toner case 5 is not attached to the apparatus main body 1, the valve 54 closes the ventilation port 5130 of the main body 51. With this configuration, when the toner case 5 is conveyed, the valve 54 prevents the toner 9 from leaking from the main body 51.

In addition, in a state where the toner case 5 is attached to the apparatus main body 1, the valve 54 opens a part of the ventilation port 5130. This avoids a negative pressure from being generated in the main body 51 when the toner 9 is fed.

In the toner case 5, the toner 9 is conveyed in a state where the toner conveyance path 530 in the cylindrical body 53 is filled with the toner 9. As a result, if a negative pressure is generated in the main body 51, it would adversely affect the feeding of the toner 9 from the main body 51. Accordingly, the valve 54 produces an advantageous effect in this context as well.

Second Embodiment

Figure 8:
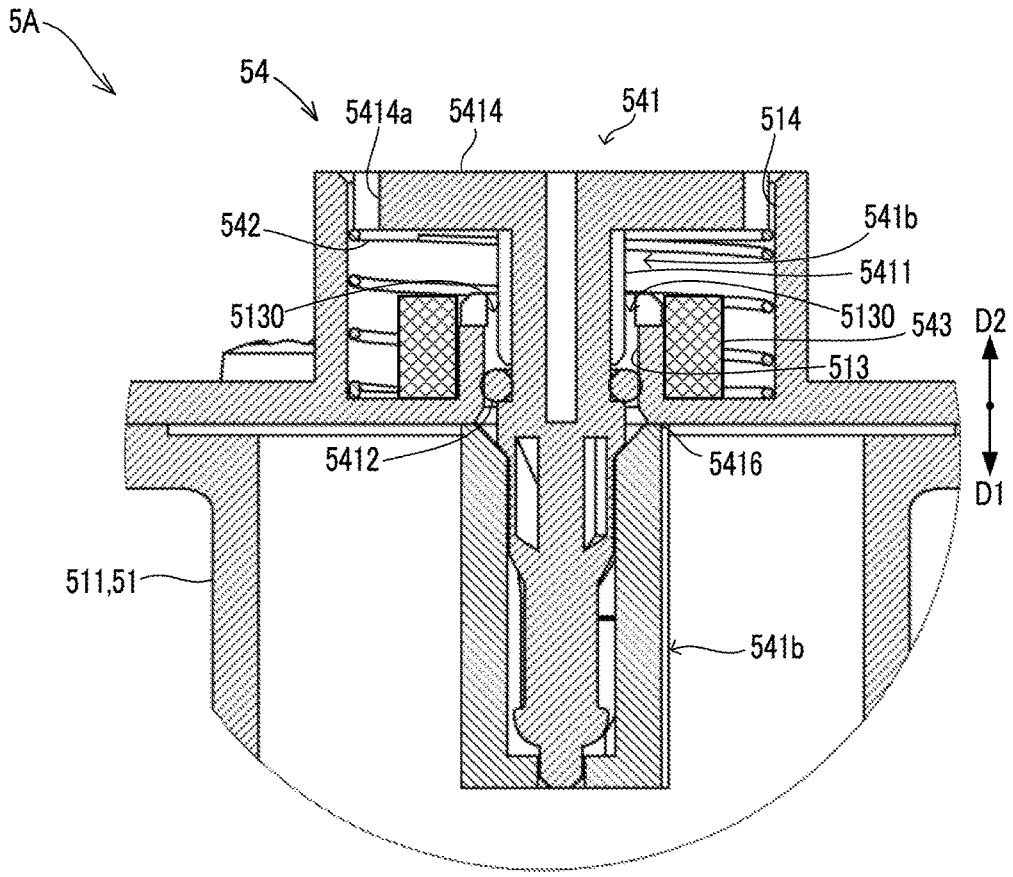
FIG. 8 is a cross-sectional diagram showing that a valve included in a toner case according to a second embodiment is in a closing state.
Figure 9:
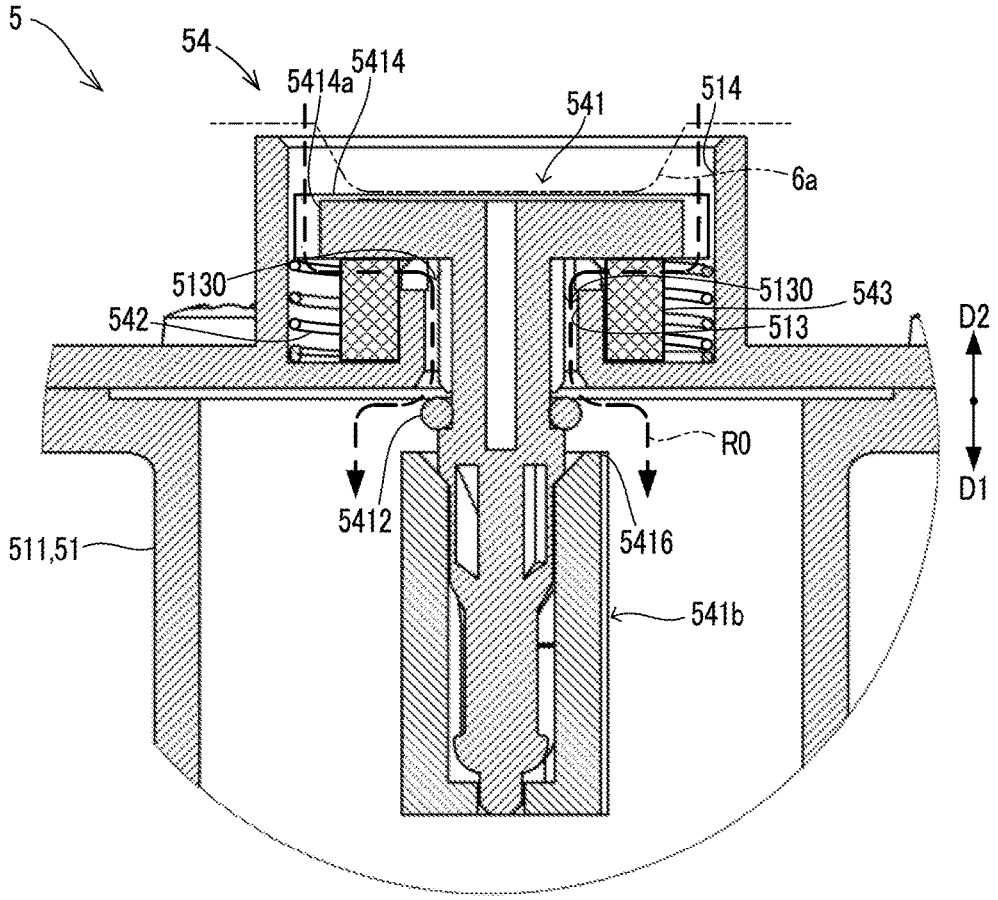
FIG. 9 is a cross-sectional diagram showing that the valve included in the toner case according to the second embodiment is in an opening state.

Next, a toner case 5A according to a second embodiment is described with reference to FIG. 8 and FIG. 9. In FIG. 8 and FIG. 9, components that are also shown in FIG. 1 to FIG. 7 are assigned the same reference signs.

In the following description, differences of the toner case 5A from the toner case 5 are described. The toner case 5A additionally has a filter 543, compared to the toner case 5.

The filter 543 covers a space that is communicated with the ventilation port 5130 outside the main body 51 in a state where the displacement member 541 is present at the opening position (see FIG. 9). The filter 543 is formed from a material that is air permeable and can catch the floating toner 9.

In the present embodiment, the filter 543 is a cylindrical member surrounding the circumference of the opening edge portion 513. In a state where the displacement member 541 is present at the opening position, the filter 543 covers the gap between the outer side surface of the main body 51 and the flange portion 5414 of the displacement member 541.

For example, the filter 543 may be a continuous foam sponge. The continuous foam sponge is an example of an open-cell foam formed from an elastic material such as rubber.

The toner case 5A produces the same advantageous effect as the toner case 5. Furthermore, in a state where the toner case 5A is attached to the apparatus main body 1, the filter 543 prevents the toner 9 from leaking from the main body 51 during a stop of the screw feeder 52.

Application Example

In the toner case 5, the valve 54 may be omitted. In that case, the filter 543 may be fixed to the main body 51 in such a way as to cover the ventilation port 5130 of the main body 51.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner case comprising:

a case main body which stores toner and in which a ventilation port is formed;

a feeding mechanism configured to feed the toner to outside the case main body;

a displacement member including a seal portion and configured to be displaced between a closing position and an opening position, wherein when the displacement member is at the closing position, the seal portion closes the ventilation port, and when the displacement member is at the opening position, the seal portion opens at least a part of the ventilation port; and an elastic member configured to hold the displacement member at the closing position by applying an elastic force to the displacement member, wherein the displacement member is configured to be displaced in a first displacement direction and a second displacement direction, the first displacement direction being directed from an outer side of the case main body toward an inner side of the case main body via the ventilation port, the second displacement direction being opposite to the first displacement direction;

the displacement member comprises a combination of a first displacement member and a second displacement member;

the first displacement member comprises:

a pass-through portion configured to pass through the ventilation port;

a flange portion that is integrally formed with the pass-through portion at the outer side of the case main body;

a first engaging portion that is integrally formed with the pass-through portion at the inner side of the case main body; and the seal portion that is formed around an entire outer circumference of the pass-through portion between the flange portion and the first engaging portion, and is configured to be displaced from a position where the seal portion closes a gap between the pass-through portion and a ventilation edge portion that is an edge of the ventilation port of the case main body, to a position in the case main body that is separated from the ventilation port, when the displacement member is displaced from the closing position in the first displacement direction;

at least a part of the second displacement member is provided on the inner side of the case main body;

the second displacement member comprises:

a second engaging portion engaging with the first engaging portion; and a stopper configured to suppress the displacement member from being displaced in the second displacement direction in a state where the displacement member contacts the inner side of the case main body at the closing position;

the elastic member is provided on the outer side of the case main body, and applies an elastic force in the second displacement direction on the flange portion; and the seal portion closes the gap between the pass-through portion and the ventilation edge portion by coming in contact with an inner circumferential surface of the ventilation edge portion in the state where the displacement member is at the closing position.

2. The toner case according to claim 1, further comprising:

a filter member configured to cover a space that is communicated with the ventilation port outside the case main body in a state where the displacement member is at the opening position.

3. An image forming apparatus comprising:

a developing device configured to develop an electrostatic latent image on a photoconductor into a toner image; and the toner case according to claim 1 configured to be attached, in a detachable manner, to an apparatus main body storing the developing device and supply toner to the developing device.

* * * * *